US005105218A

United States Patent [19]

Ikeda et al.

[11] Patent Number: 5,105,218

[45] Date of Patent: Apr. 14, 1992

[54] METHOD OF RESETTING TONER SHORTAGE OF AN IMAGE FORMING APPARATUS

[75] Inventors: Takashi Ikeda, Yokohama; Moriyuki Koike, Kawasaki, both of Japan

[73] Assignee: Ricoh Company, Ltd., Tokyo, Japan

[21] Appl. No.: 444,951

[22] Filed: Dec. 4, 1989

[30] Foreign Application Priority Data

Dec. 7, 1988 [JP] Japan ..... 63-158543[U]

[51] Int. Cl.[5] ..... G03G 21/00

[52] U.S. Cl. ..... 355/206; 355/209; 355/246; 118/689

[58] Field of Search ..... 355/204–206, 355/209, 246; 118/689–691

[56] References Cited

U.S. PATENT DOCUMENTS

| | | | |
|---|---|---|---|
| 4,669,856 | 6/1987 | Yamada | 355/209 |
| 4,687,320 | 8/1987 | Nakanishi et al. | 355/206 |
| 4,739,367 | 4/1988 | Watanabe et al. | 355/204 |
| 4,839,691 | 6/1989 | Tagawa et al. | 355/245 X |
| 4,873,549 | 10/1989 | Tada et al. | 355/206 |
| 4,916,490 | 4/1990 | Tanaka et al. | 355/245 |
| 4,952,976 | 8/1990 | Katoh et al. | 355/206 |

FOREIGN PATENT DOCUMENTS

| | | | |
|---|---|---|---|
| 0263974 | 12/1985 | Japan | 355/246 |
| 0050162 | 3/1986 | Japan | 355/206 |
| 0246766 | 11/1986 | Japan | 355/206 |
| 0080670 | 4/1987 | Japan | 355/206 |
| 0098374 | 5/1987 | Japan | 355/206 |
| 0078185 | 4/1988 | Japan | 355/209 |
| 0140176 | 6/1989 | Japan | 355/206 |
| 2184960 | 7/1987 | United Kingdom | 355/246 |

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

A method of resetting a toner shortage condition and a toner shortage indication associated with a developing device of an image forming apparatus. When the developing device has reached a toner shortage condition, a toner stortage indication is produced for urging one to supply a fresh toner or to replace a toner cartridge. The toner shortage condition and toner shortage indication are reset only when a predetermined period of time expires from the instant when one opens a door or a cover of the apparatus for the supply of toner to the instant when one closes it after the supply of toner.

6 Claims, 7 Drawing Sheets

METHOD OF RESETTING TONER SHORTAGE OF AN IMAGE FORMING APPARATUS

BACKGROUND OF THE INVENTION

The present invention generally relates to an image forming apparatus and, more particularly, to a method of resetting a toner shortage condition and a toner shortage indication of an image forming apparatus.

An electrophotographic copier, facsimile machine, laser printer or similar electrophotographic image forming apparatus is extensively used. Many of such apparatuses have a developing device of the kind using a one-component developer which is constituted by a toner only or a two-component developer which is a mixture of toner and carrier. This kind of developing device has an image carrier in the form of a photoconductive element, a developing roller for developing a latent image electrostatically formed on the image carrier by a toner which is fed to the periphery thereof, and a toner hopper for supplying the toner to the roller. More specifically, in a developing device which uses a two-component developer, a toner hopper is loaded with a toner only while a developing unit is loaded with a mixture of toner and carrier, i.e. a developer. A toner supply roller is interposed between the toner hopper and the developing unit and controlled to supply an adequate amount of toner from the toner hopper to the developing unit. On the other hand, a developing device implemented by a one-component developer has a toner hopper which is formed as a part of a developing unit, because the developer does not contain a carrier.

It is a common practice to provide a developing device of the kind described with an arrangement for determining whether or not an amount of toner great enough to develop a latent image on an image carrier is present. This urges one to supply a fresh toner or to replace a toner cartridge when the toner available in the developing apparatus is short. Various approaches have been proposed in the past for detecting a shortage of toner in the developing device. One of them is to sense the amount of toner existing in the toner hopper in terms of the vibration of toner or the pressure acting on the toner. Another approach relies on the variation in the load acting on an agitator or similar rotatable member which is installed in the toner hopper. Alternatively, the density of a toner image produced on the photoconductive element by development may be sensed. Further, the varying ratio of the toner to the carrier in the developer which exists in the developing unit may be sensed. When it is determined that the toner is short by any of such approaches, the shortage is displayed on an operation board of the apparatus to urge one to supply fresh toner.

The shortage of toner in the developing device is usually displayed in two consecutive stages, i.e., a toner near-end stage and a toner end stage. Specifically, when the sensing arrangement determines that the toner is short, a toner near-end signal is produced to turn on a toner near-end indication on the operation board. In the toner near-end stage, it is possible to produce a predetermined number of more copies, such as fifty more copies, if desired. However, the toner near-end indicator continues to alert a person to the short supply of toner. When the predetermined number of more copies have been produced, a toner end signal apprears to produce a toner end indication on the operation board and, in this stage, any further copying operation is inhibited. Usually, the toner near-end indication and the toner end indication are implemented by the flashing and the continuous glowing of an LED, respectively. In response to the toner near-end or the toner end indication, one may supply fresh toner by opening a part of the toner hopper or, when the developing device is of the type using a toner cartridge, by replacing the empty cartridge with a new cartridge.

In any case, after the supply of fresh toner or the replacement of the toner cartridge, it is necessary to reset (turn off) the toner near-end or the toner end indication. To reset the indication, use may be made of a switch that produces an on/off signal in interlocked relation with the opening and closing of a door included in the image forming apparatus. In the case of an arrangement wherein on the detection of the shortage of toner in a toner cartridge an indicator alerts a person to the short supply of toner, the indicator may be reset as soon as the person replaces the old toner cartridge with a new toner cartridge, as disclosed in Japanese Patent Laid-Open Publication (Kokai) No. 63-210975.

The switch scheme stated above can surely reset the indication because the switch is interlocked with a door which is necessarily opened and closed to supply fresh toner. However, a problem is that when the door is opened and closed for a certain purpose other than for supplying a toner, the indication is also reset. Specifically, when the door is operated for an unexpected purpose after the toner end indication has been produced to disable the apparatus, the indication will be reset allowing one to regard that the apparatus is ready to operate. Assuming that the apparatus is continuously operated in such a condition, a toner near-end signal appears in due course to turn on the toner near-end indication again and thereby allows extra copies to be produced by the toner remaining in the developing device. If such a resetting operation is repeated a number of times, the developing device itself will soon run out of toner. Should the copying operation be repeated without any toner, reproduced images would have poor density or the carrier existing in the developer alone would deposit on the photoconductive element to cause troubles in the apparatus. On the other hand, a problem with the cartridge replacement scheme is that disproportionately complicated control circuitry is needed for causing an indicator to continuously turn on the indication until the old toner cartridge has been replaced with a new toner cartridge, resulting in an increase in the cost of the apparatus.

SUMMARY OF THE INVENTION

It is therefore an object of the present invention to provide a method which resets a toner shortage condition and a toner shortage indication in an image forming apparatus while eliminating the problems particular to the prior are discussed above.

It is another object of the present invention to provide a generally improved method of resetting a toner shortage condition and a toner shortage indication in an image forming apparatus.

A method of resetting a toner shortage condition and a toner shortage indication associated with a developing device of an image forming apparatus of the present invention comprises detecting a toner shortage condition in the developing unit, displaying the detected toner shortage condition, supplying fresh toner to the developing unit, detecting a time when the fresh toner has begun to be supplied, determining whether or not a predetermined period of time has expired since that time, and resetting the toner shortage condition and a toner shortage indication only when the predetermined period of time has expired.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
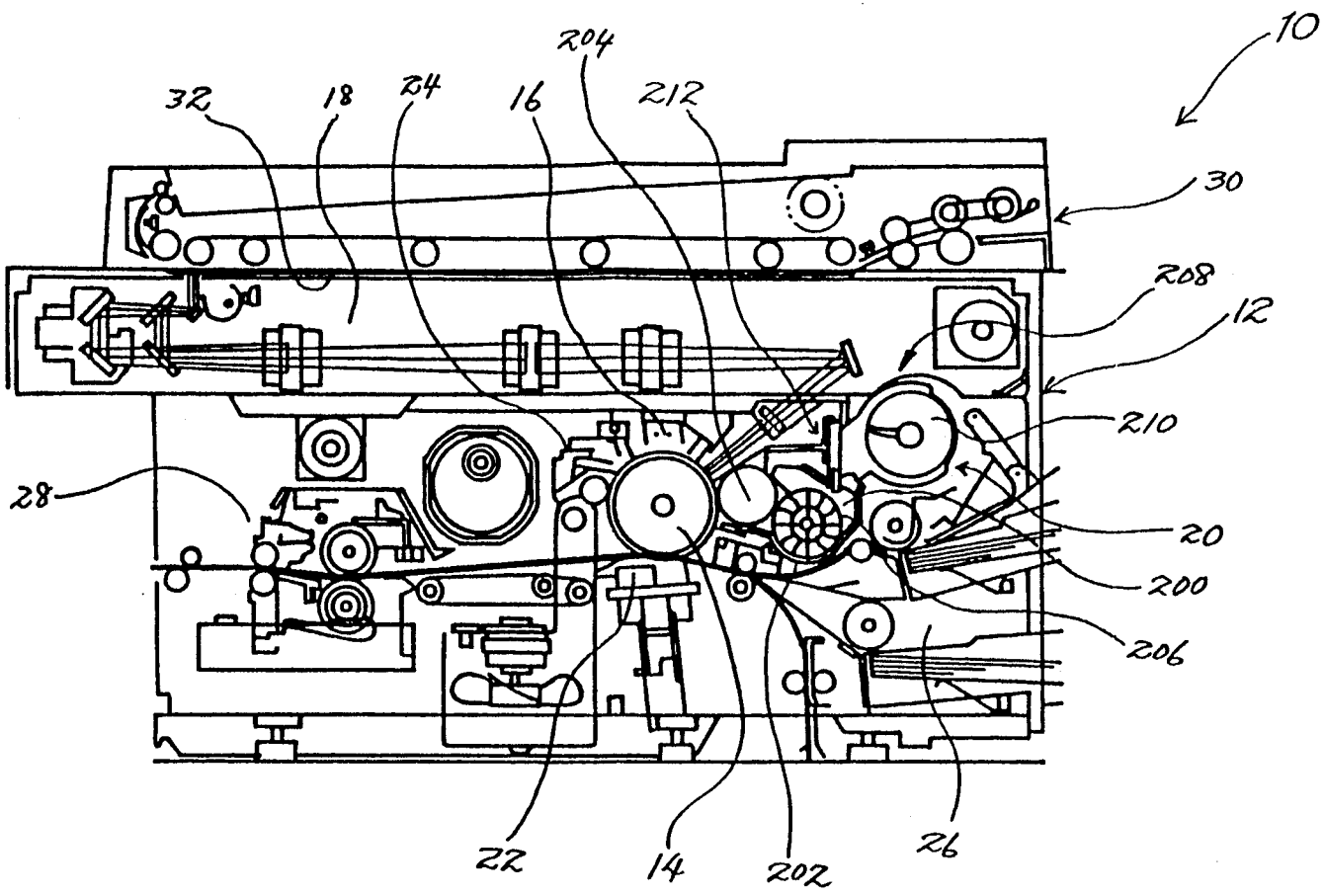
FIG. 1 is a sectional front view of an electrophotographic copier to which a method of the present invention is applicable.

Referring to FIG. 1 of the drawings, an electrophotographic copier belonging to a family of image forming apparatuses to which the present invention is applicable is shown and generally designated by the reference mumeral 10. The copier 10 which is of a conventional type has a body 12 and an image carrier in the form of a photoconductive drum 14. Arranged around the drum 14 are a main charger 16, optics 18 for imagewise exposure, a developing device 20, an image transferring and paper separating device 22, and a cleaning device 24. A paper feeding device 26 and a fixing device 28 are mounted on the body 12. The paper feeding device 26 feeds paper sheets one by one, while the fixing device 28 fixes a toner image having been transferred from the drum 14 to the paper sheet. An automatic document feeder (ADF) 30 is mounted on the top of the body 12 for automatically feeding documents one by one a glass platen 32. The method of the present invention is practiced with an arrangement which is associated with the developing device 20. Specifically, the developing device 20 has a developing unit 200 which is composed of a housing 202 and a developing sleeve 204 and an agitator 206 incorporated in the housing 202. Mounted on the top of the developing unit 202 are a toner hopper 208 and a toner sensor 212. The toner hopper 208 accommodates a toner cartridge 210 for supplying a developer or toner to the developing unit 200, the toner sensor 212 is responsive to the presence/absence of toner. The toner sensor 212 may be implemented by the previously stated prior art arrangement, and redundant description will be avoided for simplicity.

Figure 2:
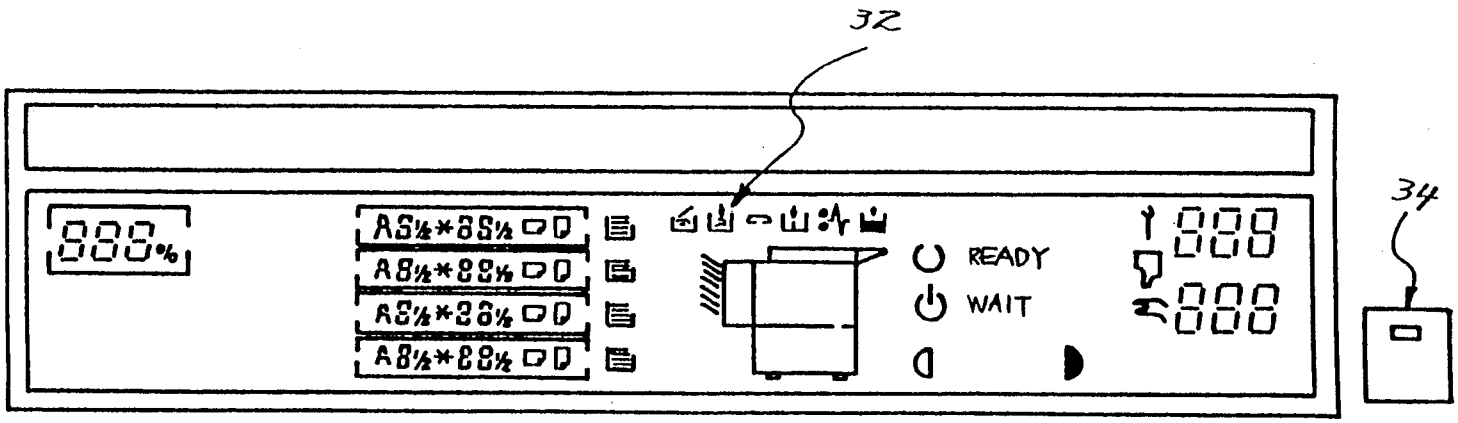
FIG. 2 is a front view of an operation board mounted on the copier of FIG. 1.
Figure 3:
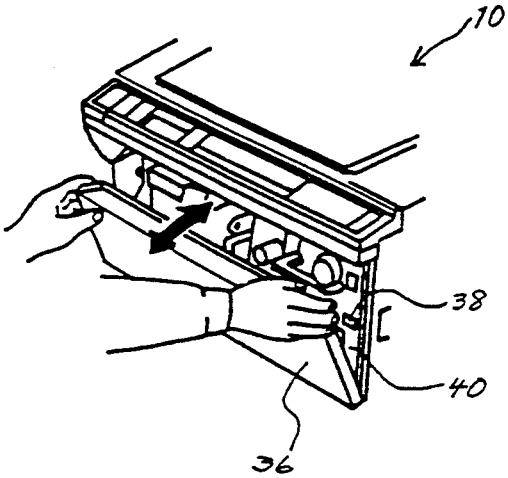
FIGS. 3 and 4 are views demonstrating a specific arrangement for supplying a toner.
Figure 4:
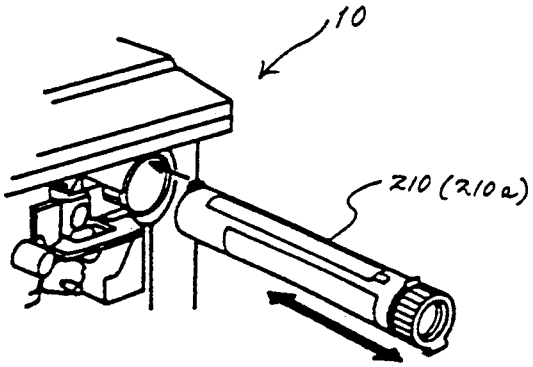

As shown in FIG. 2, an operation board mounted on the copier 10 has a light emitting diode 32 (LED) for alerting a person to the shortage of toner in the toner hopper 208 or in the developing unit 200. When the toner sensor 212 determines that the toner in the toner hopper 208 or the developing unit 200 is short, the LED 32 flashes to provide a toner near-end indication. Then, after a predetermined number of extra copies, such as fifty copies have been produced, the LED 32 continuously glows so as to provide a toner end indication. At the same time, an LED 34 associated with a print key which is also provided on the operation board glows in red to show that the copier 10 is not operable any further. As shown in FIGS. 3 and 4, a person alerted by the LED 32 which is either flashing or glowing opens a front cover 36 of the copier 10, then replaces the old toner cartridge 210 with a new toner cartridge 210*a*, and then closes the front cover 36. An actuator 40 is mounted on the front cover 36 for operating a door switch 38 which is mounted on the body 12. The toner end indication is reset by the on/off operation of the switch 38.

Figure 5:
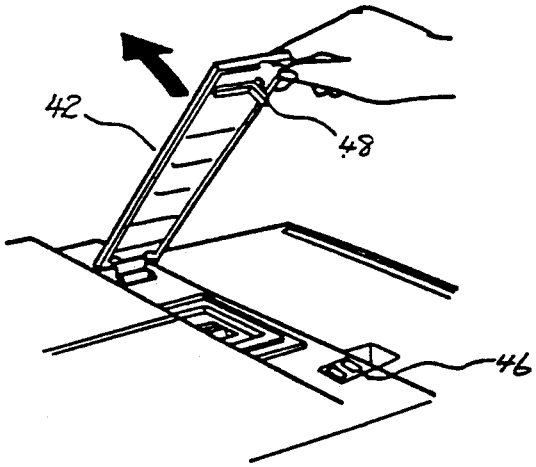
FIGS. 5 and 6 are views showing another specific arrangement for supplying a toner.
Figure 6:
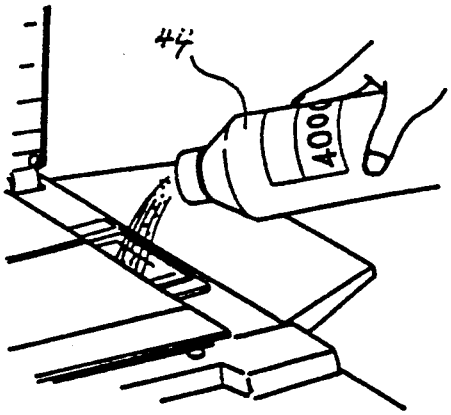

Another specific procedure is shown in FIGS. 5 and 6 which is applicable to an arrangement wherein an exclusive cover 42 is provided and openable for supplying toner into the toner hopper 208 or the developing unit 200 from a toner bottle 44. As shown, a door switch 46 is mounted on the body 12 while an actuator 48 is mounted on the exclusive cover 42 for operating the door switch. The toner shortage indication is reset by the on/off operation of the switch 46.

In accordance with the present invention, in any of the arrangements shown in FIGS. 3 and 4 and FIGS. 5 and 6 the toner shortage indication is reset only when a predetermined period of time expires from the instant of the turn-on of the switch 38 or 46 to the instant of the turn-off of the same.

Figure 7:
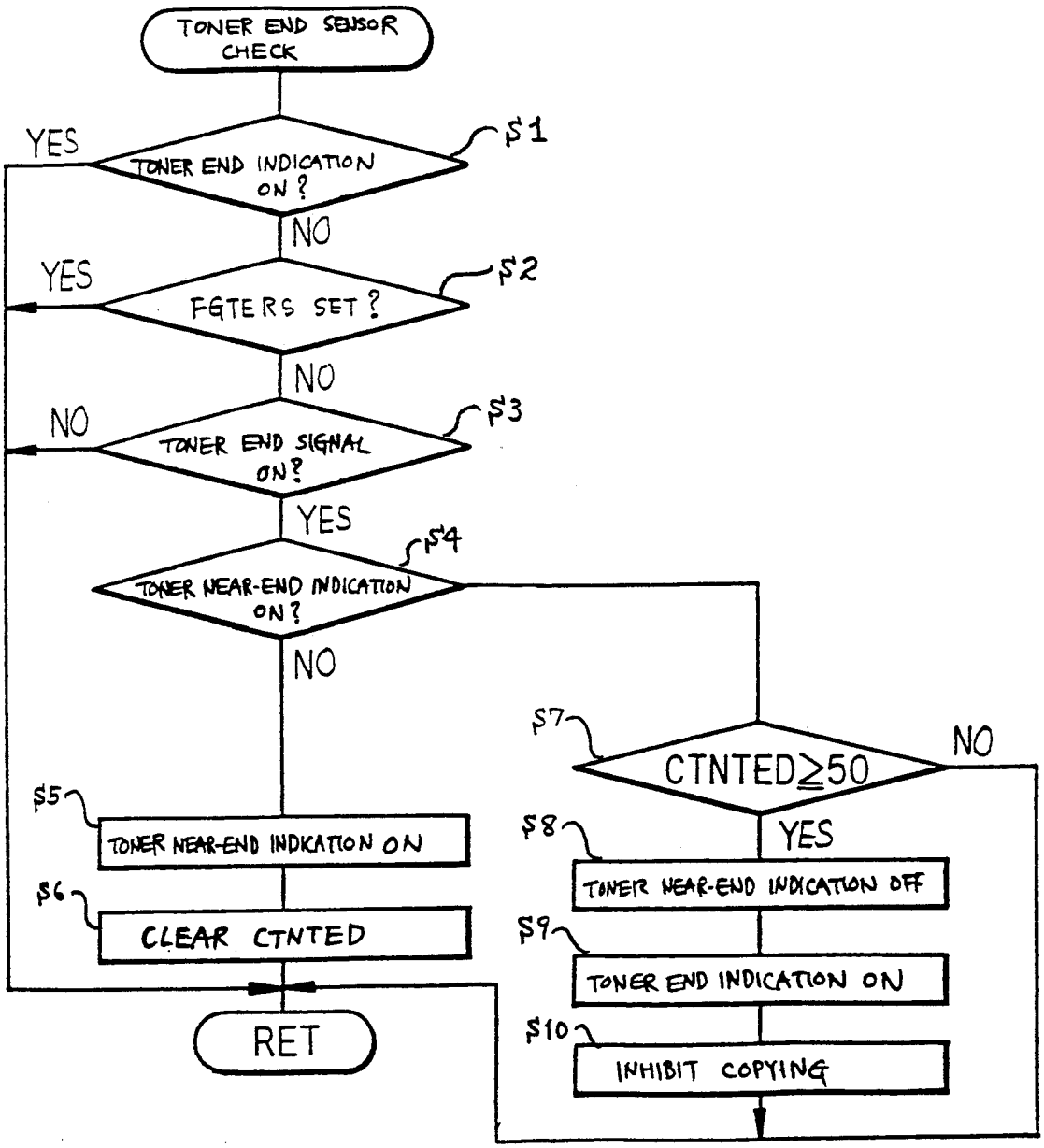
FIGS. 7 to 10 are flowcharts representative of specific operations in accordance with the present invention.

Referring to FIGS. 7 to 10, a specific operation in accordance with the present invention will be described. FIG. 7 shows a toner end sensor check routine. The routine begins with a step S1 for determining whether or not the toner end indication has been turned on. If the answer of the step S1 is YES, meaning that a toner end state has been reached, the program is returned without executing the successive steps because it is not necessary to check a toner end signal from the toner sensor 212. If the answer of the step S1 is NO, whether or not a flag FGTERS is set is determined (step S2). This flag FGTERS is used to prevent the toner end signal from being checked in order to eliminate inaccurate toner end detection. If the flag FGTERS is set as determined in the step S2, the program is also returned without checking the toner end signal. If the answer of the step S2 is NO, whether or not the toner end signal has been turned on is determined again (step S3). If the answer of the step S3 is NO, the program is returned without checking the toner end signal; if otherwise, whether or not a toner near-end indication has been turned on is determined (step S4). If the answer of the step S4 is NO, the toner near-end indication is turned on by determining that the signal has reached a positive-going edge (step S5). In the toner near-end condition, a predetermined number of more copies, such as fifty more copies, may be produced by using the remaining toner while, in the toner end condition which follows the toner near-end condition, the copying operation will be practically inhibited. In a step S6, a counter CTNTED for counting the predetermined number of copies is cleared. If the answer of the step S4 is YES, whether or not the counter CTNTED has counted the predetermined number of copies, fifty copies in the illustrative embodiment (step S7). If the answer of the step S7 is YES, it is determined that the copier has reached a toner end condition. In the following step S8, the toner near-end indication is turned off and, in a step S9, a toner end indication is turned on. Then, any further copying operation is inhibited (step S10). Thereafter, the program awaits the supply of toner and the resetting of the toner end indication which it will execute.

Figure 8:
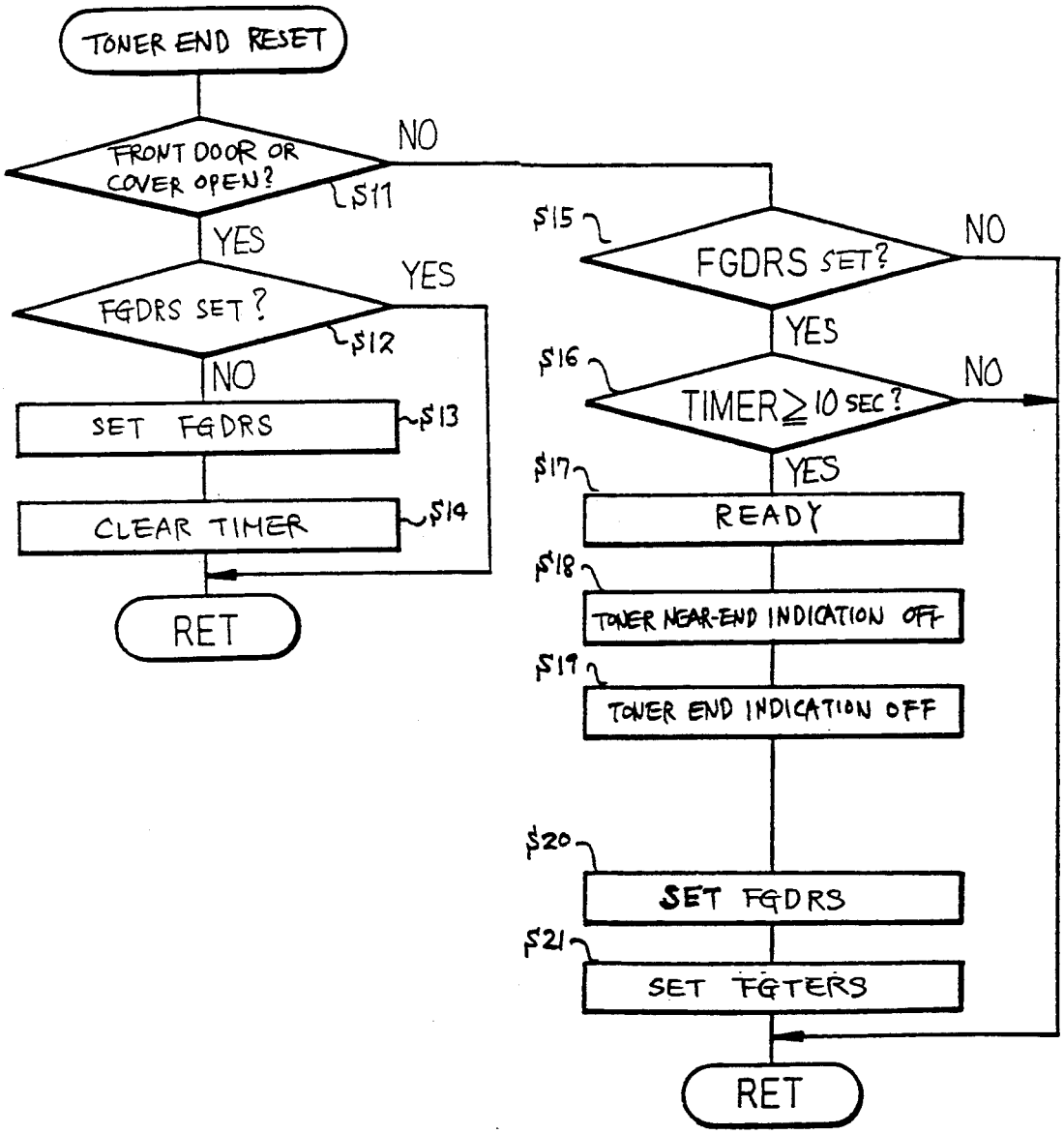

FIG. 8 shows a toner end reset routing which is executed in response to the opening and closing of the front door 36 (FIG. 3) or the exclusive cover 42 (FIG. 5). As shown, whether or not the front door 36 or the cover 42 is open determined (step S11). If it is open, a step S12 is executed to see if a flag FGDRS for sensing a positive-going/negative-going edge of a door signal or a cover signal is set. If the answer of the step S12 is NO, the program determines that a positive-going edge has been reached and sets the flag FGDRS in order to memorize it (step S13). Subsequently, a timer TIMER for determining whether or not the flag FGDRS has been reset without the supply of toner is cleared (step S14). The timer TIMER is adapted to count the opening time and closing time of the front door 36 or the cover 42. When the door signal or the cover signal has not reached a positive-going edge, the timer TIMER is not cleared because the flag FGDRS will have been set. If the front door 36 or the cover 42 is closed as determined in the step S11, whether or not the flag FGDRS has been set is determined (step S15). If the answer of the step S15 is YES, the program determines that the signal has reached a negative-going edge, i.e., that the door 36 or the cover 42 has just been closed. Then, whether or not the timer TIMER has counted 10 seconds is determined (step S16). If the answer of the step S16 is YES, i.e., if the front door 36 or the cover 42 has been kept open for 10 seconds or more, the program displays an operable state or ready state by determining that a toner has been supplied (step S17) while turning off the toner-near end indication and toner end indication (steps S18 and 19). Finally, the flags FDGRS and FGTERS are reset (steps S20 and S21).

Figure 9:
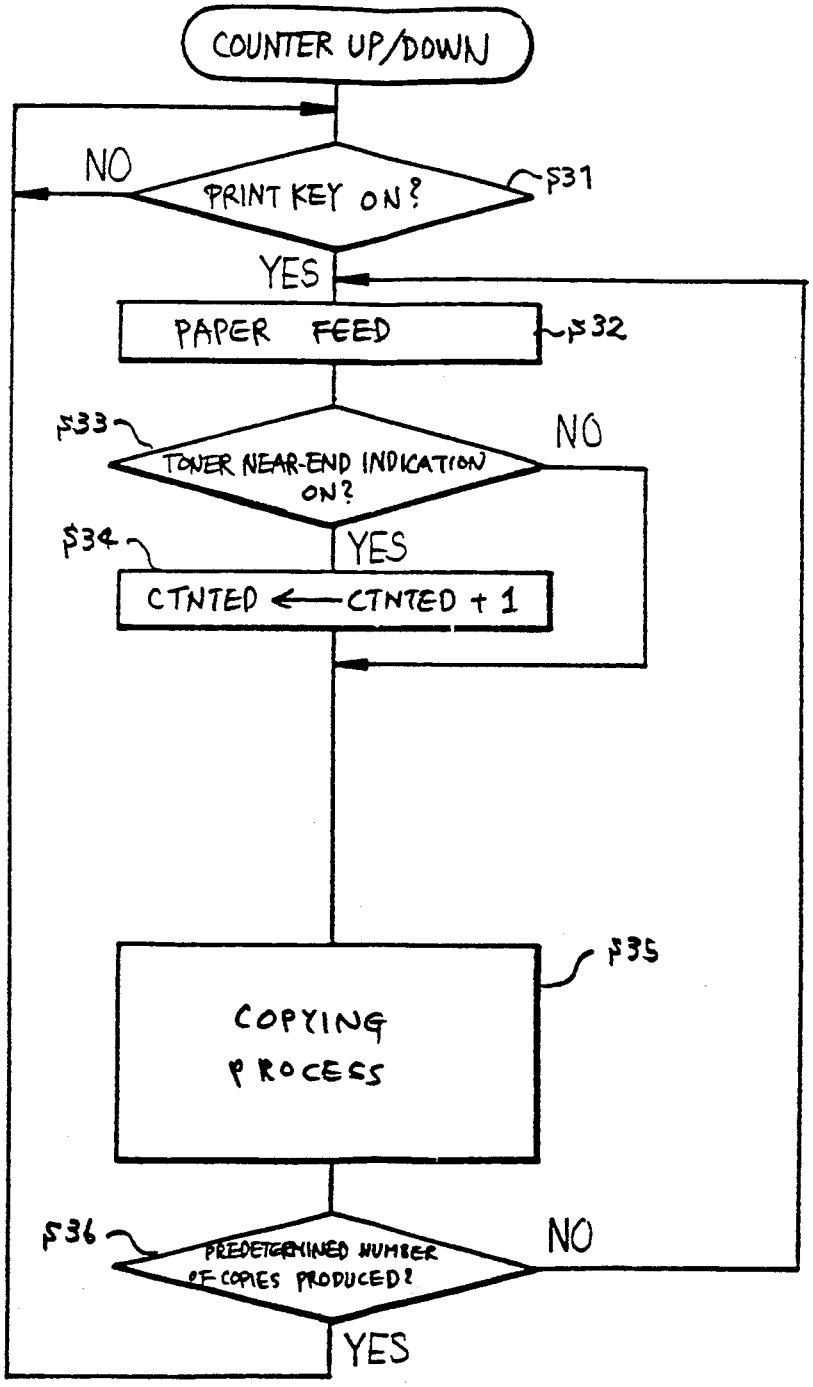

FIG. 9 demonstrates the operation of the counter. The counter CTNTED is incremented every time a copy is produced. Whether or not the print key has been turned on is determined in a step S31. If the answer of the step S31 is YES, a paper sheet is fed (step S32). Then, if the toner near-end indication has been turned on is determined (step S33). If it has been turned on, the counter CTNTED is incremented to count fifty copies (step S34). If the answer of the step 33 is NO, a copying process is excuted (step S35). Subsequently, whether or not the predetermined number of copies have been produced is determined (step S36).

Figure 10:
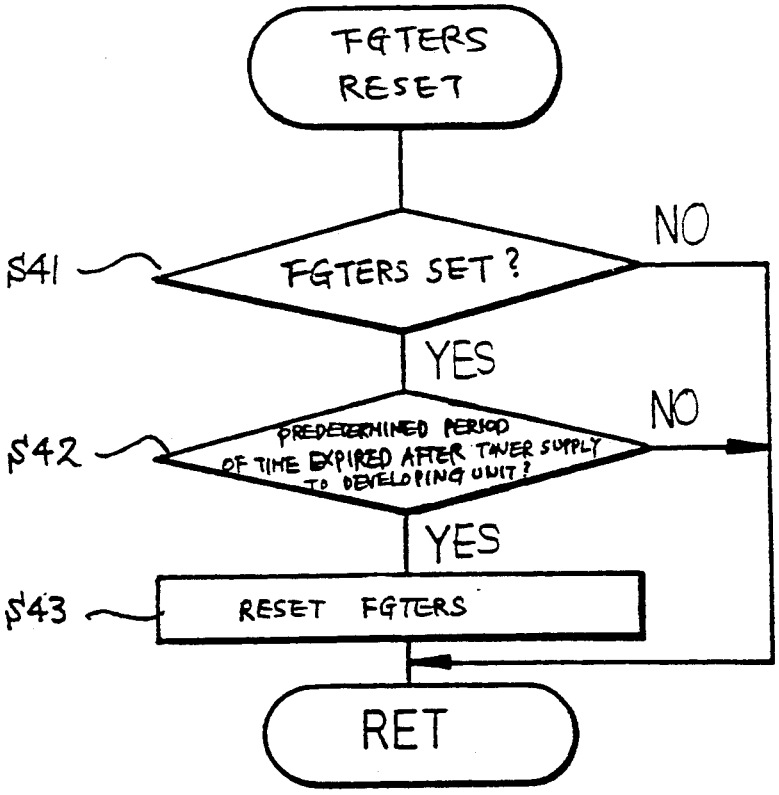

FIG. 10 indicates how the flag FGTERS is reset in a flowchart. As shown, whether or not the flag FGTERS is set is determined (step S41). If the answer is YES, a step S42 is executed to see if a predetermined period of time has expired since supplying toner into the developing unit 200. If the answer of the step S42 is YES, the flag FGTERS is reset (step S43).

In accordance with the present invention, the toner shortage indication is reset when the front cover or the exclusive cover has been kept open for 10 seconds or more, as stated above. Such a specific period of time stems from the fact that it usually takes a person more than 10 seconds to replace a toner cartridge, and the fact that one begins to feel uneasy when three seconds or more expires without any action after opening the door as proved by a panel test.

In summary, in accordance with the present invention, a toner end indication is not reset when a front door or an exclusive cover of an image forming apparatus is opened for a moment, i.e., it is turned off only after a toner has been supplied.

Various modifications will become possible for those skilled in the art after receiving the teachings of the present disclosure without departing from the scope thereof.

What is claimed is:

1. A method of resetting a toner shortage condition and a toner shortage indication associated with a developing device of an image forming apparatus, wherein said toner shortage condition comprises a toner near-end condition and a toner end condition and said toner shortage indication comprises a toner near-end indication and a toner end indication, said method comprising the steps of:

(a) detecting a toner shortage condition in the developing device;
(b) displaying said detected toner shortage condition;
(c) supplying a fresh toner to the developing device;
(d) detecting a time when said fresh toner has begun to be supplied;
(e) determining whether or not a predetermined period of time has expired since said time; and
(f) resetting said toner shortage condition and a toner shortage indication only when said predetermined period of time has expired.

2. A method as claimed in claim 1, wherein said step (b) of displaying said detected toner shortage condition comprises causing an indicator to flash for indicating said toner near-end condition and causing said indicator to continuously glow for indicating said toner end condition.

3. A method as claimed in claim 1, wherein said step (c) of supplying a fresh toner to the developing unit comprises supplying fresh toner to the developing device for replacing an empty toner cartridge with a full toner cartridge.

4. A method as claimed in claim 3, wherein the detecting process of step (d) is initiated or stopped by causing a switch, which is interlocked with an opening and closing of an openable member, to produce an on signal or an off signal in response to an opening or closing of said openable member, and wherein the openable member is opened and closed for supplying fresh toner or replacing an empty toner cartridge.

5. A method as claimed in claim 4, wherein the determination step (e) comprises driving a timer for said predetermined period of time after said switch has produced an on signal or an off signal.

6. A method as claimed in claim 5, wherein said predetermined period of time is 10 seconds.

* * * * *